United States Patent [19]

Sato et al.

[11] Patent Number: 5,065,809

[45] Date of Patent: Nov. 19, 1991

[54] METHOD FOR CASTING TITANIUM OR TITANIUM-BASED ALLOY

[75] Inventors: Takashi Sato, 3-23, Nishitaga 1-Chome, Sendai-Shi, Miyagi; Yoji Iwanabe, Miyagi; Koji Arato, Miyagi; Rokuro Sakagami, Miyagi; Yasuo Yoneda, 910, Chokeiji, Takaoka-Shi, Toyama, all of Japan

[73] Assignees: Mitsui Engineering & Shipbuilding Co., Ltd., Tokyo; Yasuo Yoneda, Takaoka; Takashi Sato, Sendai, all of Japan

[21] Appl. No.: 676,318

[22] Filed: May 28, 1991

[51] Int. Cl.[5] ..... B22D 27/16

[52] U.S. Cl. ..... 164/61; 164/66.1; 164/492; 164/57.1

[58] Field of Search ..... 164/67.1, 55.1, 57.1, 164/492–495, 66.1, 65, 68.1, 61

[56] References Cited

U.S. PATENT DOCUMENTS 2,814,560 11/1957 Ballantine ..... 164/68.1

3,226,102 12/1965 Pagonis ..... 164/493

FOREIGN PATENT DOCUMENTS 2818442 10/1979 Fed. Rep. of Germany ..... 164/61

*Primary Examiner*—Richard K. Seidel
*Assistant Examiner*—Edward A. Brown
*Attorney, Agent, or Firm*—Kanesaka and Takeuchi

[57] ABSTRACT

A method for producing a cast of titanium or a titanium-based alloy by fusing titanium or a titanium-based alloy containing an alloy element in a vacuum furnace while introducing argon gas therein and casting the resultant melt in mold, which method is characterized by adjusting the introduction of the argon gas so that the argon gas pressure (atm) in the furnace assumes the following magnitude proportionately to the alloy element content M (% by weight):

Not less than 2.1 when $0 \leqq M < 5$
Not less than 1.6 when $5 \leqq M < 10$
Not less than 1.5 when $10 \leqq M < 15$
Not less than 1.2 when $15 \leqq M$.

4 Claims, No Drawings

METHOD FOR CASTING TITANIUM OR TITANIUM-BASED ALLOY

BACKGROUND OF THE INVENTION

1. Field of the Invention

This invention relates to a method for the production of a cast of titanium or a titanium-based titanium alloy having no internal faults by mainly using sponge titanium, mill titanium bars, or titanium scraps as a main raw material, fusing the main raw material, and pouring the resultant melt in a mold.

2. Description of the Prior Art

As widely known, titanium or a titanium-based alloy is exceedingly active in a molten state and unusually susceptible to oxidation during the process of fusing or casting. For the production of a cast of titanium or a titanium-based alloy, therefore, the skull fusing method using an electron beam furnace, a vacuum arc furnace, or a vacuum induction furnace is employed.

In the fusion of the raw material in accordance with the skull fusing method, however, there arises the disadvantage that the melt in the furnace is not fully degasified and the produced cast tends to contain numerous pore defects referred to as gas porosity or microporosity notwithstanding the melt is held under such a high degree of vacuum as $10^{-6}$ Torr as in the electron beam furnace or under a reduced pressure of argon gas from 400 to 600 Torr as in the vacuum arc furnace or the vacuum induction furnace.

The disadvantage of this, nature may be alleviated, for example, by improving the schedule of casting as by increasing the feeder head or enlarging the gate. The melt entraining pore faults may be mended by being squeezed with hot isostatic pressure (HIP) and consequently deprived of the pore faults. Further, by adopting the method of centrifugal casting which brings about the effect of a feeder head by virtue of centrifugal force, there may be obtained a cast possessing a dense texture containing only very few pore faults.

The increase of the feeder head or the enlargement of the gate, however, involves waste of the melt and inevitably impairs the yield of casting and, at the same time, compels the subsequent treatment to demand time and labor. Further, the hot isostatic press (HIP) entails the disadvantage that the process of treatment required for its operation is complicated to a great extent. The centrifugal casting necessitates special devices as for rotation and retention of the mold and incurs the problem of a high cost of equipment.

SUMMARY OF THE INVENTION

An object of this invention is to provide a method for casting titanium or a titanium-based alloy, which precludes the disadvantages of the prior art mentioned above and allows a cast of titanium or a titanium-based alloy containing no internal faults such as pore faults to be produced in a high yield without involving any complicated process of treatment or using any special device otherwise required in the case of centrifugal casting.

To be specific, this invention is directed to a method for the production of a cast of titanium or a titanium-based alloy by fusing titanium or a titanium-based alloy containing an alloy element in a vacuum furnace while introducing argon gas into the vacuum furnace and casting the resultant melt, which method is characterized by the fact that the introduction of the argon gas is adjusted so that the argon gas pressure (atm) in the vacuum furnace assumes the following magnitude in accordance with the content, M (% by weight), of the alloy element:

Not less than 2.1 when $0 \leqq M < 5$

Not less than 1.6 when $5 \leqq M < 10$

Not less than 1.5 when $10 \leqq M < 15$

Not less than 1.2 when $15 \leqq M$.

The present inventor, in view of the fact that establishment of a technique capable of producing a cast of titanium or a titanium-based alloy containing no pore fault in a high yield without involving any complicated process of treatment or using any special device otherwise required in the case of centrifugal casting constitutes itself an important task, has carried out various studies and experiments over many years to date, to find that the pore faults are caused in the cast of titanium or a titanium-based alloy rather by volatile impurities in the molten raw material than by the reaction of the mold or the inclusion in the melt of the atmospheric gas inside the furnace. In consequence of a study continued on the basis of this finding, the inventor has completed the present invention.

When titanium or a titanium-based alloy is subjected to induction fusion in the atmosphere of argon gas kept under the pressure determined in accordance with the composition of the raw material as defined above, the raw material can be fused in a homogeneous state while avoiding such adverse phenomena as bumping and hanging of the melt and the melt can be smoothly poured into the mold. Further, since the melt is poured under the pressure of argon gas, the otherwise inevitable occurrence of pore faults inside the cast can be precluded and the occurrence of the so-called gas porosity or microporosity can be substantially completely prevented.

DESCRIPTION OF THE PREFERRED EMBODIMENTS

The method of this invention which produces a cast by fusing titanium or a titanium-based alloy containing an alloy element in a vacuum furnace while introducing argon gas into the furnace and casting the resultant melt in a mold can be easily executed in accordance with the conventional method except for the fact the introduction of the argon gas is adjusted so that the argon gas pressure (atm) assumes the following magnitude proportionately to the content, M (% by weight), of the alloy element in the raw material.

Not less than 2.1, preferably 2.3 to 2.8 when $0 \leqq M < 5$

Not less than 1.6, preferably 1.8 to 2.1 when $5 \leqq M < 10$

Not less than 1.5, preferably 1.5 to 1.8 when $10 \leqq M < 15$

Not less than 1.2, preferably 1.2 to 1.5 when $15 \leqq M$

The titanium or the titanium-based alloy on which the method of this invention is effectively executed is not specifically restricted. The following titanium alloys may be cited as useful raw materials, for example.

Ti-0.3Mo-0.8Ni (% by weight)

Ti-5Al-2.5Sn (% by weight)

Ti-6Al-4V (% by weight)

Ti-10V-3Al-2Fe (% by weight)

Ti-15V-3Cr-3Al-3Sn (% by weight)

Ti-13V-11Cr-3Al (% by weight)

For titanium alloys having alloy element contents, $M \leqq 27$, the method of this invention proves to be particularly effective.

A cast of titanium or a titanium-based alloy of high internal soundness can be produced in the furnace interior atmosphere of argon gas pressure variable in the range of from 1.2 atmospheres to 3 atmospheres with the alloy composition as demonstrated in the working examples of this invention to be cited hereinbelow. Of course, a cast of high internal soundness can be obtained under an argon gas pressure exceeding 3 atmospheres. The higher argon gas pressure is uneconomical because it requires introduction of expensive argon gas in a greater amount into the furnace and necessitates use of a special furnace capable of withstanding the high pressure. Thus, it is safe to conclude that this invention has no use for the introduction of the argon gas in an amount enough for the furnace interior argon gas pressure to exceed 3 atmospheres.

In accordance with the method of this invention, a cast of titanium or a titanium-based alloy of high internal soundness can be produced as described above by fusing the titanium or the titanium-based alloy in a vacuum furnace while adjusting the argon gas pressure in the furnace proportionately to the alloy composition. Thus, the method of this invention obviates the necessity of using any special device, allows the conventional vacuum furnace to be used in its unmodified form, and ensures production of a cast of titanium or a titanium-based alloy containing no pore faults. It also enjoys a high yield of casting because no conspicuous addition is required for the feeder head or the gate.

Further, the fact that the raw material is fused in an atmosphere of argon gas of increased pressure brings about an additional effect of allowing the melt to be obtained in a homogeneous state while avoiding such adverse phenomena as bumping or hanging of the melt and enabling the melt to be smoothly poured into the mold.

Now, this invention will be described more specifically below with reference to working examples.

EXAMPLE 1

About 400 g of sponge titanium placed in a lime crucible was preheated under $10^{-4}$ Torr at 800° C. for 20 minutes by the use of a vacuum induction furnace rated at 10 kw in power source capacity and 70 KHz in frequency. Subsequently, the titanium was thoroughly fused in the furnace under continued introduction of argon gas with the temperature elevated to a range of from about 1,700° C. to about 1,750° C. The melt was cast by the upper pouring method into a lime mold, to produce a platelike cast measuring 12 mm in thickness, 60 mm in width, and 120 mm in length.

The cast samples were tested for X-ray transmission. According to the results of this test, a sample fused and cast under an atmosphere of argon gas pressure of 2 atmospheres had pore faults dispersed throughout the volume of the plate and a sample fused and cast under an atmosphere of argon gas pressure of 2.5 atmospheres had a sound texture showing no internal pore fault.

EXAMPLE 2

Four hundred (400) g of commercially available mill titanium bars (Ti-0.064% Fe) were fused and cast by following the procedure of Example 1. A sample produced by fusing and casting the raw material under an argon gas pressure of 1.5 atmospheres was found to have pore faults dispersed throughout the entire volume of the plate and a sample produced by fusing and casting the raw material under an argon gas pressure of 2.5 atmospheres was found to contain absolutely no discernible pore fault.

EXAMPLE 3

A melt of Ti-15% Al alloy was prepared by fusing 400 g of sponge titanium under an atmosphere of argon gas pressure of 1.5 atmospheres and, at the same time, adding pure aluminum thereto. The melt was poured into a mold of the same size as in Example 1 under the same atmosphere of argon gas, to produce a platelike cast.

By the X-ray examination, the cast was found to have a sound texture. In contrast, a sample produced by fusing and casting the raw material under an atmosphere of argon gas pressure of 1 atmosphere was found to have pore faults dispersed throughout the entire volume of the plate.

EXAMPLE 4

A melt of Ti-6% Al alloy was prepared by fusing 400 g of sponge titanium under an atmospheres of argon gas pressure of 2.5 atmospheres while adding pure aluminum thereto. The melt was poured into a mold of the same size as in Example 1 under the same atmosphere of argon gas, to produce a platelike cast.

The cast was found by the X-ray examination to have a sound texture. In contrast, a cast produced by fusing and casting the raw material under an atmosphere of argon gas pressure of 1.5 atmospheres was found to have pore faults dispersed throughout the entire volume of the plate.

EXAMPLE 5

A melt of Ti-13% V-11% Cr-3% Al alloy was prepared by fusing 400 g of sponge titanium under an atmosphere of argon gas pressure of 1.5 atmospheres and, at the same time, adding pure vanadium, pure chromium, and pure aluminum thereto. This melt was cast into a mold of the same size as in Example 1 under the same atmosphere of argon gas, to produce a platelike cast.

The cast was found by the X-ray examination to have a sound texture. In contrast, a sample produced by fusing and casting the raw material under an atmosphere of argon gas of 1 atmosphere was found to have pore faults dispersed throughout the entire volume of the plate.

EXAMPLE 6

A melt of Ti-0.3% Mo-0.8% Ni alloy was prepared by fusing 400 g of sponge titanium under an atmosphere of argon gas pressure of 3 atmospheres and, at the same time, adding pure molybdenum and pure nickel thereto. This melt was cast into a mold of the same size as in Example 1 under the same atmosphere of argon gas, to produce a platelike cast.

The cast was found to have a sound texture. In contrast, a sample produced by fusing and casting the raw material under an atmosphere of argon gas pressure of 2 atmospheres was found to have pore faults dispersed throughout the entire volume of the plate.

EXAMPLE 7

A melt of Ti-10% V-2% Fe-3% Al alloy was prepared by fusing 400 g of sponge titanium under an atmosphere of argon gas pressure of 1.2 atmospheres and, at the same time, adding pure vanadium, pure iron, and pure aluminum thereto. This melt was poured into a mold of the same size as in Example 1 under the same atmosphere of argon gas, to produce a platelike cast.

This cast was found by the X-ray examination to have a sound texture. In contrast, a sample produced by fusing and casting the raw material under an atmosphere of argon gas pressure of 1 atmosphere was found to have pore faults dispersed throughout the entire volume of the plate.

EXAMPLE 8

A melt of Ti-6% Al-4% V alloy was prepared by fusing 400 g of sponge titanium under an atmosphere of argon gas pressure of 1.5 atmospheres and, at the same time, adding pure aluminum and pure vanadium thereto. This melt was poured into a mold of the same size as in Example 1 under the same atmosphere of argon gas, to produce a platelike cast.

This case was found by the X-ray examination to have a sound texture. In contrast, a sample produced by fusing and casting the raw material under an atmosphere of argon gas pressure of 1.1 atmospheres was found to have pore faults dispersed throughout the entire volume of the plate.

EXAMPLE 9

A melt of Ti-5% Al-2.5% Sn alloy was prepared by fusing 400 g of sponge titanium under an atmosphere of argon gas pressure of 2.8 atmospheres and, at the same time, adding pure aluminum and pure tin thereto. This melt was poured into a mold of the same size as in Example 1 under the same atmosphere of argon gas, to produce a platelike cast.

This cast was found by the X-ray examination to have a sound texture. In contrast, a sample produced by fusing and casting the raw material under an atmosphere of argon gas pressure of 1.5 atmospheres was found to have pore faults dispersed throughout the entire volume of the plate.

EXAMPLE 10

A melt of Ti-8% Mn alloy was prepared by fusing 400 g of sponge titanium under an atmosphere of argon gas pressure of 1.5 atmospheres and, at the same time, adding pure manganese thereto. This melt was poured into a mold of the same size as in Example 1 under the same atmosphere of argon gas, to produce a platelike cast.

This cast was found by the X-ray examination to have a sound texture. In contrast, a sample produced by fusing and casting the raw material under an atmosphere of argon gas pressure of 1.0 atmosphere was found to have pore faults dispersed throughout the entire volume of the plate.

What is claimed is:

1. A method for the production of a cast of titanium or a titanium-based alloy by fusing titanium or a titanium-based alloy containing an alloy element in a vacuum furnace while introducing argon gas into said vacuum furnace and casting the resultant melt, which method comprises providing the following relationships for the argon gas pressure (atm) in said vacuum furnace in accordance with the content, M (% by weight), of said alloy element:

Not less than 2.1 when $0 \leqq M < 5$
Not less than 1.6 when $5 \leqq M < 10$
Not less than 1.5 when $10 \leqq M < 15$
Not less than 1.2 when $15 \leqq M$; determining said content, M, of said alloy element; and adjusting the introduction of said argon gas in accordance with said content, M, of said alloy element.

2. A method according to claim 1, wherein said argon gas pressure is less than 3 atmospheres.

3. A method according to claim 1, wherein said titanium-based alloy has an alloy element content, M, of less than 27% by weight.

4. A method according to claim 1, wherein said argon gas pressure (atm) has the following magnitude proportionately to the indicated alloy element content (% by weight):

2.3 to 2.8 when $0 \leqq M < 5$
1.8 to 2.1 when $5 \leqq M < 10$
1.5 to 1.8 when $10 \leqq M < 15$
1.2 to 1.5 when $15 \leqq M$.

* * * * *